US010661961B2

(12) United States Patent
Beer

(10) Patent No.: US 10,661,961 B2
(45) Date of Patent: May 26, 2020

(54) VACUUM PACKAGE WITH RECLOSABLE POUR SPOUT AND HANDLE, AND METHODS OF MAKING THE SAME

(71) Applicant: Fres-co System USA, Inc., Telford, PA (US)

(72) Inventor: Jeffrey Scott Beer, Coopersburg, PA (US)

(73) Assignee: FRES-CO SYSTEM USA, INC., Telford, PA (US)

( * ) Notice: Subject to any disclaimer, the term of this patent is extended or adjusted under 35 U.S.C. 154(b) by 223 days.

(21) Appl. No.: 15/800,596

(22) Filed: Nov. 1, 2017

(65) Prior Publication Data

US 2018/0170644 A1 Jun. 21, 2018

Related U.S. Application Data

(60) Provisional application No. 62/435,150, filed on Dec. 16, 2016.

(51) Int. Cl.

| | |
|---|---|
| ***B65D 30/20*** | (2006.01) |
| ***B65D 75/58*** | (2006.01) |
| ***B65D 33/22*** | (2006.01) |
| ***B65D 75/32*** | (2006.01) |
| ***B65D 33/00*** | (2006.01) |
| ***B65D 75/12*** | (2006.01) |
| ***B65D 75/56*** | (2006.01) |
| *B65D 75/36* | (2006.01) |

(52) U.S. Cl.

CPC ..... *B65D 75/5877* (2013.01); *B65D 31/10* (2013.01); *B65D 33/007* (2013.01); *B65D 33/22* (2013.01); *B65D 75/12* (2013.01); *B65D 75/322* (2013.01); *B65D 75/566* (2013.01); *B65D 75/5855* (2013.01); *B65D 75/5866* (2013.01); *B65D 75/366* (2013.01)

(58) Field of Classification Search

CPC ..... B65D 75/12322; B65D 75/566; B65D 75/5855; B65D 75/5866; B65D 75/366; B65D 33/007; B65D 33/22; B65D 31/10

See application file for complete search history.

(56) References Cited

U.S. PATENT DOCUMENTS

| | | | | |
|---|---|---|---|---|
| 4,057,949 | A * | 11/1977 | Greffe | B65B 1/26 53/434 |
| 4,691,368 | A | 9/1987 | Roessiger | |
| 4,705,174 | A | 11/1987 | Goglio | |
| 4,738,546 | A | 4/1988 | Sengewald | |
| 4,781,471 | A | 11/1988 | Sengewald | |

(Continued)

*Primary Examiner* — Derek J Battisti

(74) *Attorney, Agent, or Firm* — Caesar Rivise, PC

(57) ABSTRACT

A flexible package and methods of making the same are disclosed. The package is formed of a flexible sheet material and includes plural panels connected together to form an internal compartment holding a flowable granular or particulate material. The package includes a transverse seal line which includes a permanently sealed section and a releasably securable sealed section. The releasably securable sealed section is configured to be peeled open to form a spout for the package. The package also includes a reclosable connector located adjacent the releasably securable section to close the spout after it has been opened. The package also includes a handle for lifting and carrying the package and for facilitating pouring the contents of the package out of the spout.

14 Claims, 4 Drawing Sheets

(56) References Cited

U.S. PATENT DOCUMENTS

| | | | | |
|---|---|---|---|---|
| 5,941,643 | A * | 8/1999 | Linkiewicz | B65B 9/20 383/210 |
| 7,040,810 | B2 * | 5/2006 | Steele | B65D 33/08 383/10 |
| 7,442,156 | B2 * | 10/2008 | Yeager | B65D 31/10 493/213 |
| 7,494,279 | B2 | 2/2009 | Marquet et al. | |
| 7,976,220 | B2 * | 7/2011 | Brauer | B65D 31/10 383/120 |
| 8,690,428 | B2 * | 4/2014 | Kruse | B65D 31/10 383/10 |
| 8,899,836 | B2 * | 12/2014 | Wedi | B65D 31/10 383/120 |
| 8,961,012 | B2 | 2/2015 | Martin et al. | |
| 9,102,453 | B2 * | 8/2015 | Koenigkramer | B65D 31/10 |
| 9,469,423 | B2 | 10/2016 | Thomas, Jr. et al. | |
| 9,856,063 | B1 * | 1/2018 | Schulz | B65D 75/566 |
| 2007/0086683 | A1 * | 4/2007 | Yeager | B65D 31/10 383/95 |
| 2008/0008406 | A1 * | 1/2008 | Russell | B65D 31/10 383/63 |
| 2009/0110334 | A1 | 4/2009 | Marquet et al. | |
| 2013/0315507 | A1 | 11/2013 | Teixido Vidal et al. | |
| 2018/0057225 | A1 * | 3/2018 | Schulz | B65D 33/01 |

* cited by examiner

VACUUM PACKAGE WITH RECLOSABLE POUR SPOUT AND HANDLE, AND METHODS OF MAKING THE SAME

CROSS REFERENCE TO RELATED APPLICATIONS

This utility application claims the benefit under 35 U.S.C. § 119(e) of Provisional Application Ser. No. 62/435,150 filed on Dec. 16, 2016 entitled Vacuum Package with Reclosable Pour Spout and Hand, and Methods of Making the Same, which is assigned to the same assignee as this application. The entire disclosure of the provisional application is incorporated by reference herein.

BACKGROUND OF THE INVENTION

Field of Invention

Flexible packages made from flexible packaging material designed to hold a product under vacuum, having an opening sealed by a peelable seal that may be hand opened and having a means for re-closure; and optionally having a handle to facilitate transport and dispensing the product.

Description of Related Art

Flexible packages formed of sheet materials have been used for many years and have wide acceptance for holding various products, e.g., coffee and other foodstuffs. Prior art flexible, air-tight packages are commonly constructed of some plastic film, metal foil, or combinations thereof, in one or more plies and sealed along one or more seams. Such packages may be vacuumized after filling, but prior to sealing, so that the contents of the package are not exposed to the degradation effects of air.

The advantages of flexible packages over rigid packages are many. For example, flexible packages can be manufactured at substantially lower cost and can be stored flat, thereby resulting in enormous space savings over rigid packages. Moreover, flexible packages are substantially lighter in weight, thereby resulting in reduced transportation costs for unfilled packages. Further still, many flexible packages are generally of an overall parallelepiped shape when filled so that such packages take up considerably less shelf or storage space. Needless to say, this feature is of considerable importance insofar as transportation, storage, and display are concerned.

It is common practice to construct such packages by heat sealing laminated material to form each package. Each package is then filled and its opening typically heat sealed closed to produce the final product for shipment. Packages of the above description may be used in vacuum packing, a familiar technique in which the contents of the package are exposed to a reduced atmosphere during the sealing operation to draw off air or to eliminate gases which otherwise might evolve or diffuse out of such contents over time.

The seals for packages of the above-described type must of course be strong enough to withstand routine handling and foreseeable mishandling, and to avoid spillage due to failure of the closure. Also, the closure must be strong enough and permanent enough to resist tampering. In typical prior art packages, the seals are often as strong as the other seams of the package. Opening may require the use of knives, scissors or other cutting instruments. As an alternative, schemes have been proposed for the use of frangible elements, tear strips or drawstrings, to facilitate opening.

Each of these in some measure complicates the production process, and results in partial or complete destruction of the package upon opening. This latter attribute is itself undesirable, for in the marketing of certain products, it is common to open the package, dispense a small quantity of the product, and then reclose the package to prevent spoilage or spillage of the contents of the package.

Certain granular or pelletized free flowing dry products are produced and shipped in very large volumes. Many of these products are packaged in rigid containers such as boxes. Some are packaged in a bag or in a so-called "bag-in-box" (a flexible bag disposed within a box). Shipping of these packages requires more volume than is required by the product due to the headspace air left in the package after filling. A very familiar example is the bag-in-box breakfast cereal. In some cases almost one half of the box volume is void of product. Thus shipments are inefficient since the truck volume is almost fifty percent air space. In addition, the box is required to make the package self-supporting.

While the packages of the prior art may be generally suitable for their intended purposes, they suffer from one or more drawbacks, e.g., shipping inefficiency, need for secondary packaging, ease of access to the contents of the package, controlled dispensing of the package's contents, and convenient storage of the product.

The subject invention addresses the needs of the prior art. In so doing it changes the primary packaging so that shipping is more efficient than current packaging and secondary packaging is reduced. Moreover, the construction of the package of the subject invention provides convenient storage of the product, while enabling easy access and controlled dispensing of the product.

SUMMARY OF THE INVENTION

One aspect of this invention is package for holding a particulate material therein. The package is formed of a flexible material and comprises a top portion, a bottom portion, a first side; an oppositely disposed second side, a front panel, a rear panel, a top transverse seal line, a bottom transverse seal line, a compartment, and a re-closable connector. The top transverse seal line has a length and is located in the top portion. The top transverse seal line seals the front panel to the rear panel along the length of the top transverse seal line. The bottom transverse seal line has a length and is located in the bottom portion. The bottom transverse seal line seals the front panel to the rear panel along the length of the bottom seal line. The compartment is configured for receipt of the particulate material therein. The compartment is formed by portions of the front and rear panels between the bottom transverse seal line and the top seal line. The top transverse seal line comprises a first section releasably securing the front and rear panels together and a second section permanently securing the front and rear panels together. The first section is configured to enable the front panel and the rear panel to be peeled open at the first section to form a pour spout in communication with the compartment, whereupon the particulate material within the compartment can be poured out of the pour spout. The re-closable connector is located between the front and rear panels and immediately adjacent the first section of the top transverse seal line and extends the length of the first section of the top transverse seal line to releasably close the pour spout after it has been opened.

In accordance with one preferred aspect of this invention the first section of the top transverse seal line comprises no more than approximately fifty percent of the length of the top transverse seal line and is formed by a releasably securable adhesive interposed between the front and rear panels at the location of the first section of the top transverse seal line.

In accordance with another preferred aspect of this invention the re-closable connector comprises a press-to-close tape.

In accordance with another preferred aspect of this invention the package is a gusseted bag having a first gusseted side panel and a second gusseted side panel, with the first gusseted side panel being secured between the front panel and the rear panel at a first side of the gusseted bag, and with the second gusseted side panel being secured between the front panel and the rear panel at a second side of the gusseted bag.

In accordance with another preferred aspect of this invention the package additionally comprises a handle located in the top portion adjacent the second section of the top transverse seal line.

In accordance with another preferred aspect of this invention the handle comprises an opening in the top portion of said package.

In accordance with another preferred aspect of this invention the package is a vacuum package that is self-supporting and can be supported on a pallet without the need for additional support.

In accordance with another preferred aspect of this invention the vacuum package has vacuum pressure inside of said package of at least 300 mm Hg.

Another aspect of this invention entails a method of making a flexible package holding a particulate material. The method comprises providing a web of flexible material having a first side edge and a second side edge, a top portion, a bottom portion and an inner surface. A releasably securable adhesive is applied on the inner surface at the top portion of the web in a pattern which extends from a point closely adjacent one of the side edges towards the middle of the web. A re-closable connector is applied on the inner surface at the top portion of the web below the releasably securable adhesive, whereupon the re-closable connector extends for a least the length of the pattern of the releasably securable adhesive. The web is formed into a tube having a front panel, a rear panel. Each of the panels has an inner surface. The tube has a width. The bottom portion of the tube is sealed along a bottom transverse line extending the width of the tube, whereupon a compartment is formed above the bottom transverse seal line. The compartment is filled with a particulate material. Heat is applied in a transverse line across the width of the tube at the location of the releasably securable adhesive, whereupon the heat forms a releasably securable seal along a first section of the transverse line and a permanent seal along a second section of the transverse line. The first section of the transverse line makes up the length of the releasably securable adhesive. The second section of the transverse line forms the remainder of the transverse line, whereupon the portion of the tube at the first section is configured to be opened to form a spout for the package. The spout is configured to be closed by the re-closable connector.

In accordance with one preferred aspect of the method of making the package of this invention the web is formed into a gusseted tube including a pair of gusseted side panels interposed between the front and rear panels on opposite sides thereof.

In accordance with another preferred aspect of the method of making the package of this invention the first section comprises no more than fifty of the width of the gusseted tube.

In accordance with another preferred aspect of the method of making the package of this invention the re-closable connector comprises a press-to-close tape.

In accordance with another preferred aspect of the method of making the package of this invention a handle is provided in the top portion of the package adjacent said second section of the transverse line.

In accordance with another preferred aspect of the method of making the package of this invention the handle comprises at least one opening in the top portion of the package and a permanent heat seal surrounding the at least one opening.

Another aspect of this invention entails a method of making a flexible precursor package configured to be filled with a particulate material and thereafter sealed. The method comprises providing a web of flexible material having a first side edge and a second side edge, a top portion, a bottom portion and an inner surface. A releasably securable adhesive is applied on the inner surface at the top portion of the web in a pattern which extends from a point closely adjacent one of the side edges towards the middle of the web. A re-closable connector is applied on the inner surface at the top portion of the web below the releasably securable adhesive, whereupon the re-closable connector extends for a least the length of the pattern of the releasably securable adhesive. The web is formed into a tube having a front panel, a rear panel. Each of the panels has an inner surface. The tube has a width. The bottom portion of the tube is sealed along a bottom transverse line extending the width of the tube, whereupon a compartment is formed above the bottom transverse seal line to form the precursor package. The precursor package is configured to have heat applied in a transverse line across the width of the tube at the location of the releasably securable adhesive, whereupon the heat forms a releasably securable seal along a first section of the transverse line and a permanent seal along a second section of the transverse line. The first section of the transverse line makes up the length of the releasably securable adhesive. The second section of said transverse line forms the remainder of the transverse line, whereupon the portion of the tube at the first section is configured to be opened to form a spout. The spout is configured to be closed by the re-closable connector.

In accordance with one preferred aspect of the method of making the precursor package of this invention the web is formed into a gusseted tube including a pair of gusseted side panels interposed between the front and rear panels on opposite sides thereof.

In accordance with another preferred aspect of the method of making the precursor package of this invention the first section comprises no more than fifty of the width of the gusseted tube.

In accordance with another preferred aspect of the method of making the precursor package of this invention the re-closable connector comprises a press-to-close tape.

DESCRIPTION OF THE DRAWING

The invention will be described in conjunction with the following drawings in which like reference numerals designate like elements and wherein.

DETAILED DESCRIPTION OF THE PREFERRED EMBODIMENT

Figure 1:
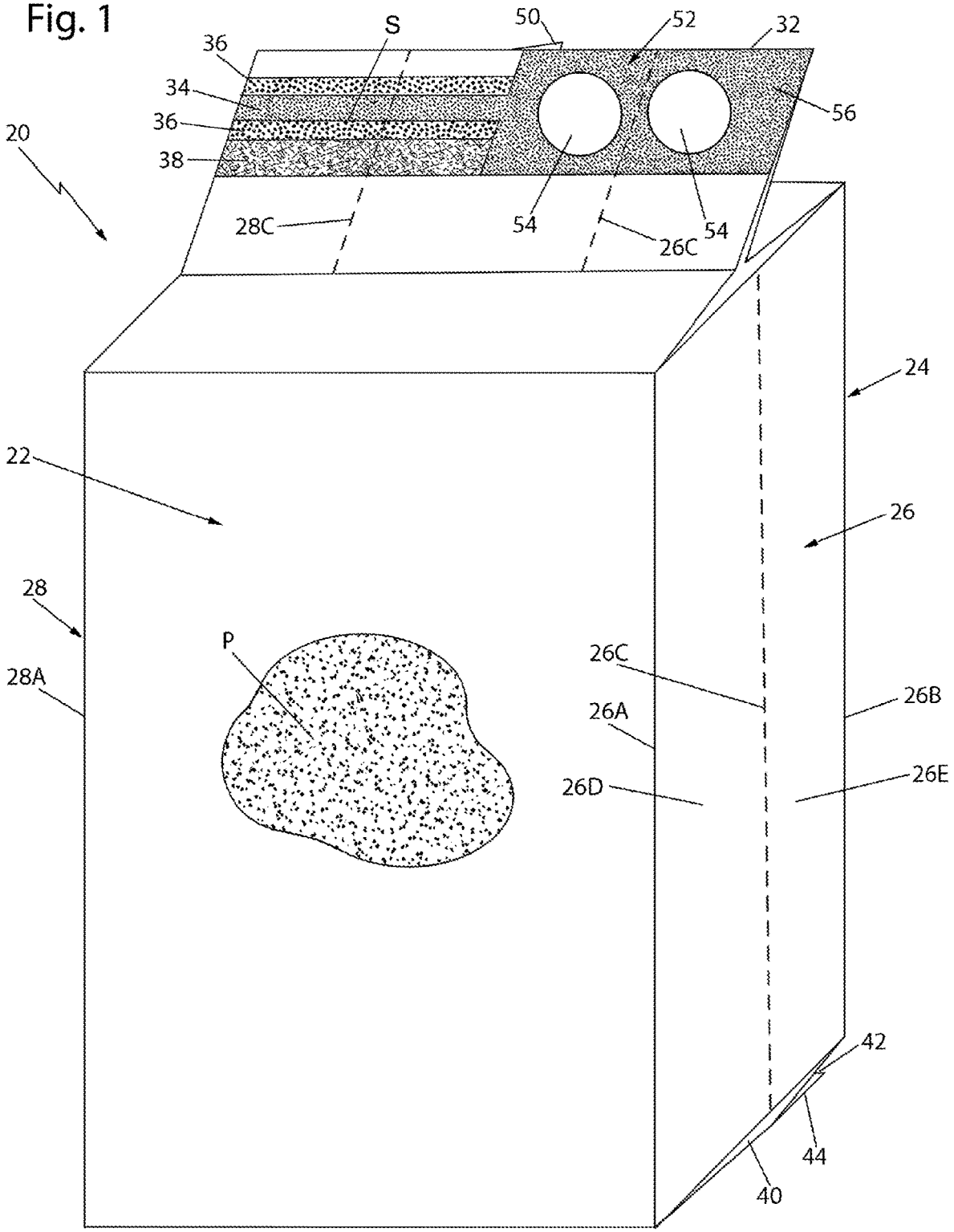
FIG. 1 is an isometric view of one exemplary package constructed in accordance with this invention.

Referring now to the various figures of the drawing wherein like reference characters refer to like parts, there is shown in FIG. 1 one exemplary embodiment of a package 20 constructed in accordance with one aspect of this invention. The package is arranged for holding a flowable particulate or granular material product P, e.g., cat litter.

The exemplary package 20 basically comprises a bag fabricated from a flexible sheet material capable of being sealed for closing off the interior of the bag from ambient atmosphere. In the exemplary embodiment the bag includes a front panel 22, a rear panel 24, a first gusseted side panel 26 and a second gusseted side panel 28. It should be pointed out that the bag may be in different form than a gusseted bag, e.g., it may be a flat bag, a stand-up pouch or some other configuration that has two or more side walls or panels and one or more seams to join the edges of the side walls or panels. The bag has an open upper end portion 30 terminating in a top free edge 32. The top portion of the bag is sealed along a transversely extending seal line 34 (FIGS. 1, 2 and 4) located a short distance below the top free edge 32. The inner surface of the bag's panels have a releasably securable adhesive 36 located in the upper end portion of the bag below the top free edge and encompassing a portion of the transverse seal line 34 to form an openable pour spout S for the bag, as will be described in considerable detail later. In addition, the bag includes a re-closable or releasably securable connector 38 located immediately below the bottom of the releasably securable adhesive 36. The re-closable connector 38 serves as a means for re-closing the pour spout S of the bag after it has been opened. The bag has a closed lower end portion 40 terminating in a bottom free edge 42. The bottom portion of the bag is sealed along a transversely extending seal line 44 located a short distance above the bottom free edge 40. The interior of the bag is in the form of a hollow compartment located between the panels of the bag and the transverse seal lines 34 and 44. It is in this compartment that the particulate material P is located and held for subsequent dispensing through the bag's pour spout S when that pour spout is opened.

Figure 4:
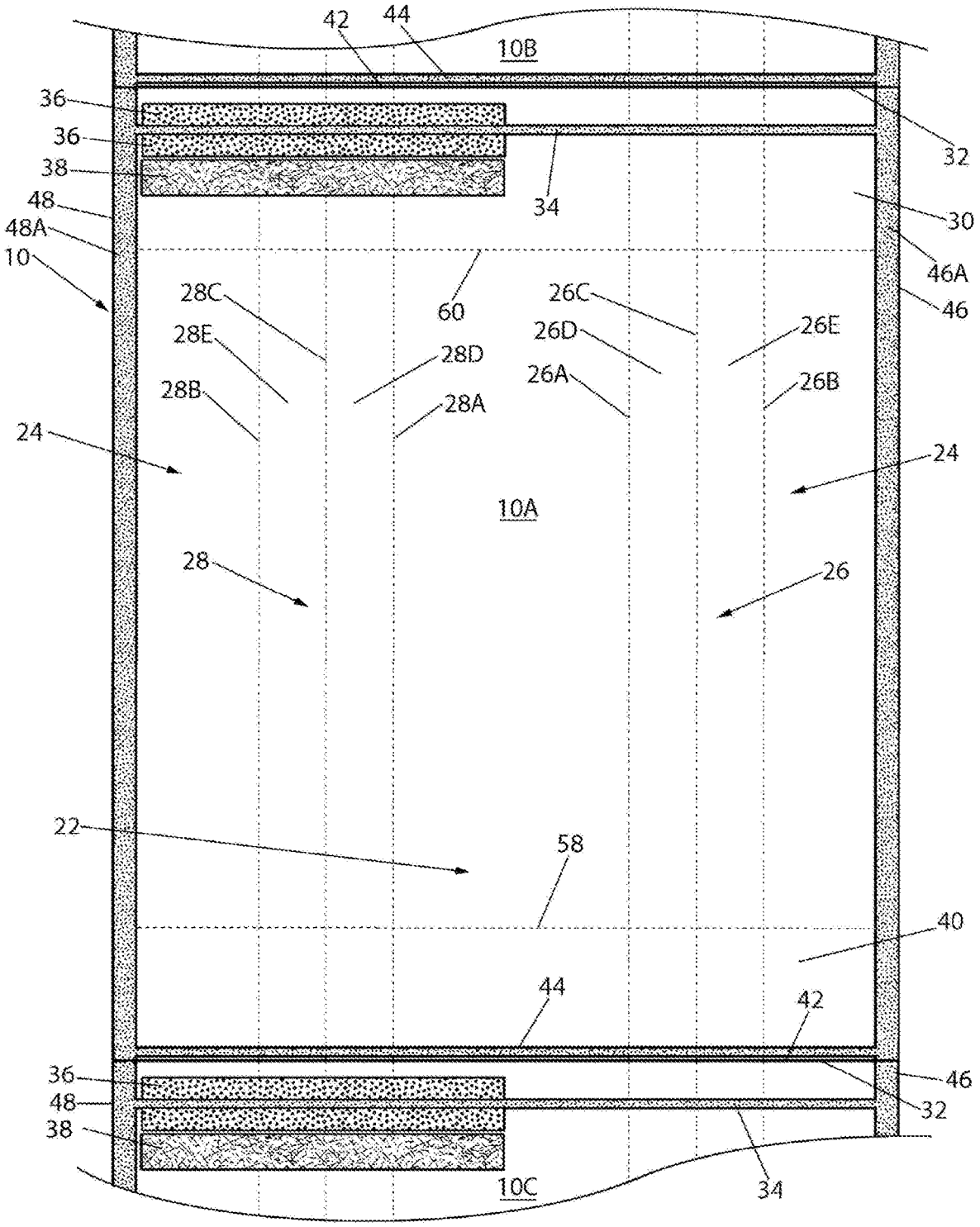
FIG. 4 is a plan view of a web of flexible material for forming precursor packages in accordance with a method of this invention and which precursor packages when filled and sealed form the completed package of FIG. 1 and the intermediate versions of the package shown in FIGS. 2 and 3.

The bag 20 is formed from a web of flexible sheet material 10. That web is shown in FIG. 4 and is in the form of a series of sheets or precursors 10A, 10B, 10C, and so on. Each of the precursors of the web is formed, filled and sealed in a continuous operation on a conventional form, fill and seal machine to produce a series of the packages 20. In FIG. 4, only three of the precursors of the continuous web are shown, namely 10A, 10B and 10C. The portion of the web designated as 10A shows the entire precursor which forms the package 20 shown in FIG. 1, whereas the portion of the web designated as 10B only shows a portion, i.e., the trailing edge of the precursor for the prior package to be produced by the form, fill and seal machine, whereas the portion of the web designated as 10C only shows a portion, e.g., the leading edge of the precursor of the next package 20 to be produced and filled after the package 20 is produced and filled from the precursor 10A.

Each precursor section or sheet of the web 10 is of identical construction. In particular, the web includes a first side edge 46, and a second side 48, a first fold line 26A, a second fold line 26B, a third fold line 26C, a fourth fold line 28A, a fifth fold line 28B, and a sixth fold line 28C. The web 10A is formed into a tube by folding it along its fold lines, whereupon the 46 and 48 are overlapped and sealed together, e.g., heat sealed, along lines 46A and 48A located at the marginal edges 46 and 48, respectively. Those sealed overlapped portions form a vertical or fin seal 50 (FIG. 1) located in the center of the rear panel 24.

The fold lines 26A, 26B and 26C, when folded form the side gusset panel 26. The gusseted side panel 26 includes a front gusset section 26D and a rear gusset section 26E. The fold line 26A forms an outer fold edge joining the front gusset section 26D to the right side edge of the front panel 22. The fold line 26B forms an outer fold edge joining the rear gusset section 26E to the right side edge of the rear panel 24. The fold line 26C is located midway between the fold lines 26A and 26B and forms an inner fold edge joining the front gusset section 26D to the rear gusset section 26E. In a similar manner, the fold lines 28A, 28B and 28C, when folded form the side gusset panel 28. The gusseted side panel 28 includes a front gusset section 28D and a rear gusset section 28E. The fold line 28A forms an outer fold edge joining the front gusset section 28D to the left side edge of the front panel 22. The fold line 28B forms an outer fold edge joining the rear gusset section 28E to the left side edge of the rear panel 24. The fold line 28C is located midway between the fold lines 28A and 28B and forms an inner fold edge joining the front gusset section 28D to the rear gusset section 28E.

The adhesive 36 is applied to the inner surface of the web 10A at the location at which the transverse seal line 24 will be made and is in the form of a pattern, e.g., a rectangle, wherein the adhesive extends from a point immediately adjacent the seal line 48 inward on the web to no more than the middle of the web. Thus the adhesive does not extend into the side seam or into more than fifty percent of the width of the upper end portion of the package. This feature increases the structural integrity of the bag and, as will be described shortly, creates a peelable portion to form the pour spout for the bag. It should be noted that the adhesive 36 is shown extending from a point immediately adjacent in seal line 48A toward the center of the web. That is merely exemplary. Thus, for example, the adhesive 36 can be applied to extend from a point immediately adjacent in seal line 46A toward the center of the web.

As mentioned earlier a releasably securable connector 38 is located on the inner surface of web of flexible sheet material immediately below pattern applied adhesive 36. In accordance with one preferred embodiment of this invention that connector is in the form of a strip of press-to-close tape, and extends parallel to the pattern applied adhesive 36, just below the pattern applied adhesive. However, if desired the connector 38 can be located just above the pattern applied adhesive 36. In any case, the strip of re-closure tape does not extend into the side seam 48A or into more than fifty percent of the upper end portion package. Rather, it is only applied to the area of the sheet of material intended to be formed into a pour spout. By applying the peel seal and re-closure tape only to the area of the package requiring opening, and specifically stopping the peel seal material prior to extending into the balance of the package mouth and into the package side seams, those areas remain permanently sealed to give the package the desired spout formation and structural integrity.

Importantly, the area of the peel seal of the present invention does not interfere with the other permanent seams of the package. The process of applying a coating to predetermined area of a laminate web is generally referred to in the flexible packaging industry as "pattern coating". The peel seal is placed on the laminated material by the "pattern coating" wherein the peel seal adhesive is placed away from the heat sealed seams and placed in a pattern only on that portion of the laminate that is actually peeled opened. Therefore, the structural integrity of the main seams is maintained.

In accordance with one exemplary preferred embodiment of this invention the web 10 is composed of a lamination typically used for vacuum packaging dry granular products. The laminations from outside to inside consist of: 12 micron polyester film; ink, adhesive; 7 micron aluminum foil, adhesive, 15 micron oriented nylon, adhesive, 75 micron polyethylene, and the pattern applied releasably securable adhesive 36.

As should be appreciated by those skilled in the art, while the package 20 has been described with specific reference for holding cat litter, which is a loose granular or particulate material that is good at absorbing moisture and odors, such as ammonia, the subject package can be used for many different products.

As can be seen in FIG. 1, the package 20 includes a handle 52 for lifting and carrying the package and for facilitating the pouring of the contents of the package out of its spout when the spout is opened. In the exemplary embodiment shown the handle is located in the upper portion 30 of the package within the remaining fifty percent of the package's width that do not make up its openable spout. The handle 20 can be of any shape, configuration or size, but in the exemplary embodiment is in the form of a pair of openings 54 located adjacent each other and surrounded by a permanent heat seal area 56. Moreover, if desired the handle can be located at different locations on the package.

The process of making the exemplary package 20 (and other packages in accordance with this invention), will now be described. To that end, a web of flexible sheet material for forming the bag is delivered in continuous roll stock format to a packaging machine, e.g., Goglio G22 form, fill and seal machine, sold by the assignee of this invention Fres-co System USA, Inc. The sheet material is unwound and the re-closure connector (e.g., press-to-seal tape) 38 is heat sealed to the inside of the web in the appropriate area. The continuous sheet is formed into a gusseted tube, applying the vertical fold lines to form the front panel 22, rear panel 24, and the interposed gusseted side panels 26 and 28, each of which as discussed above includes a front gusset section and a rear gusset section. The marginal edges 46 and 48 of the tube form a vertically extending back or fin seal 50 located in the center of the back panel 25. The back or fin seal finishes the continuous tube from the web. The bottom 50 of the package is formed by applying transverse fold lines 58 (FIG. 4) to the front and rear panels a slight distance from what will be the bottom edge 42 of the package. These fold lines cooperate with the inner fold lines 26C and 28C of the gusseted side panels 26 and 28, respectively, to form a conventional bottom of the package. The permanent transversely extending bottom seal 44 is produced by heat sealing the tube below the fold lines 58 and the continuous tube is cut just below this seal. The cut defines the closed bottom edge 42 of the package 20 and the leading or open top edge 32 of the next succeeding package from the precursor 10C in the continuous manufacturing line.

The top of the package 20 formed by the precursor 10A is open, whereupon an appropriate quantity of granular product P is filled into the package via the open top. The filled package is manipulated, such as with vibration, to settle and densify the product. The top 30 of the package is formed by applying transverse fold lines 60 (FIG. 4) to the front and rear panels a slight distance from the top edge 32 of the package. These fold lines cooperate with the inner fold lines 26C and 28C of the gusseted side panels 26 and 28, respectively, to form the top of the package in a manner similar to the formation of the bottom of the package.

Figure 2:
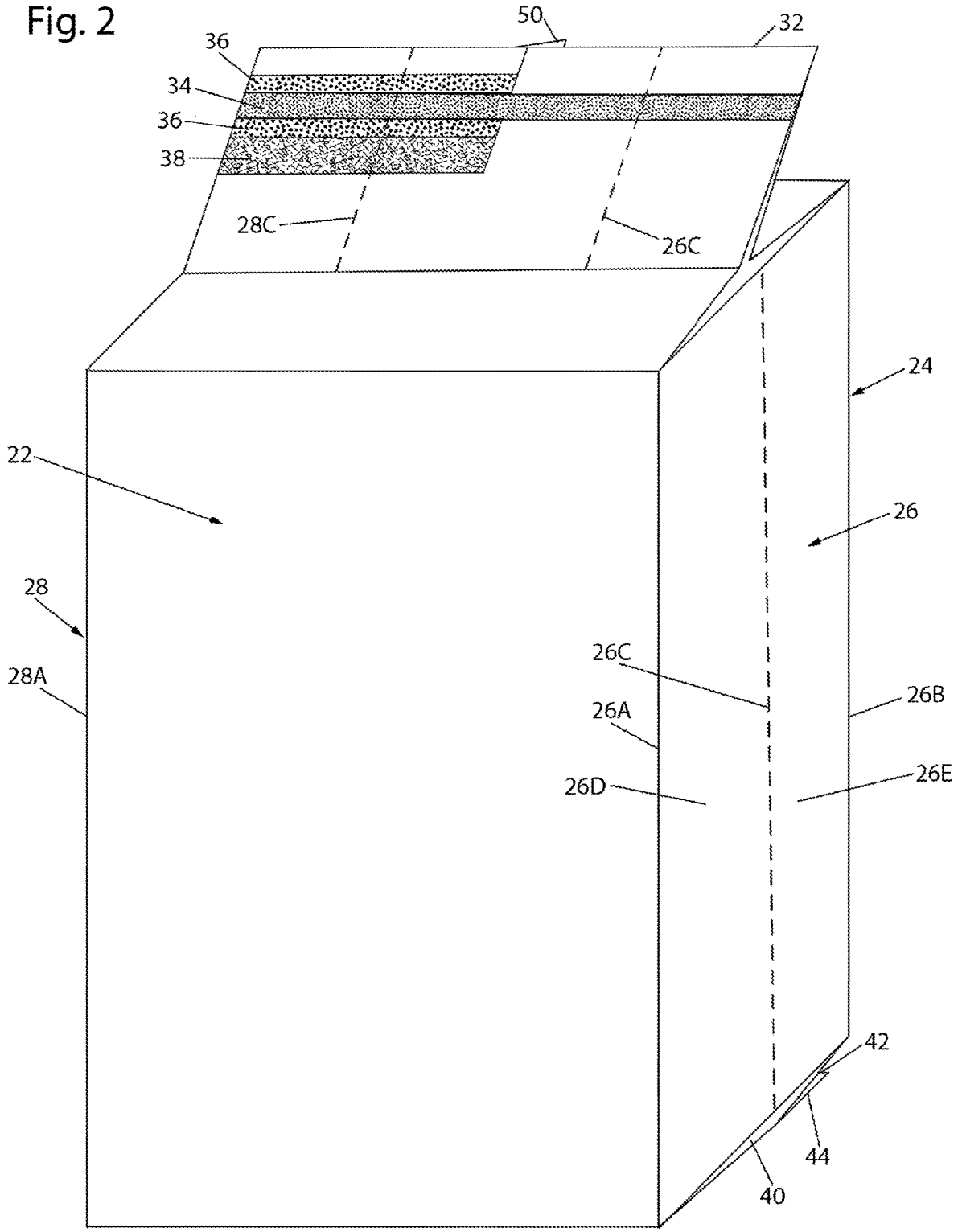
FIG. 2 is an isometric view, similar to FIG. 1, but showing the package during a point in the process of making the package.
Figure 3:
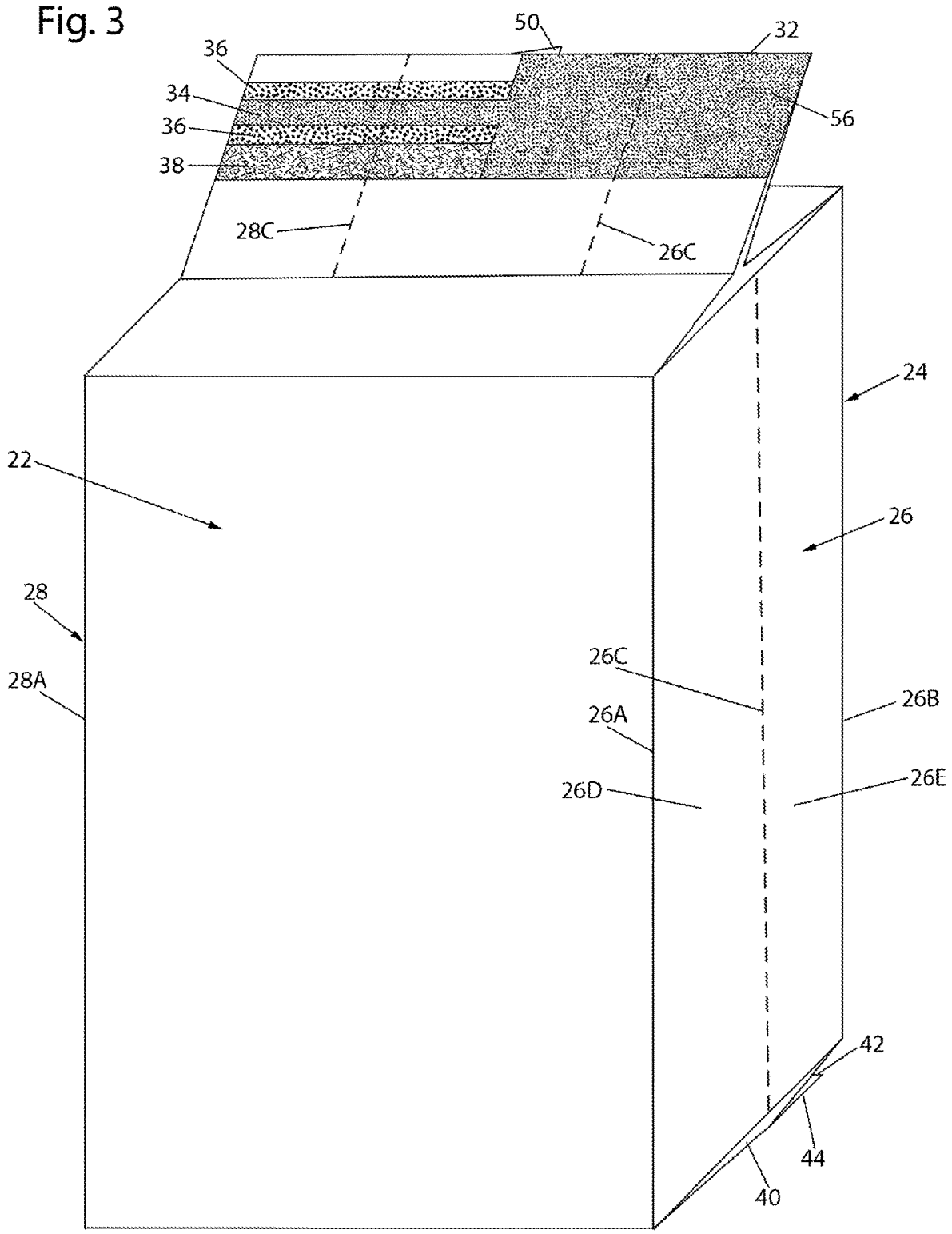
FIG. 3 is an isometric view similar to FIGS. 1 and 2, but showing the package at a later point in the process of making the package.

The formed and filled package is then placed in a vacuum chamber fitted with a top heat sealing apparatus. In particular, the portion of the top end of the package is placed between heat sealing bars of the top heat sealing apparatus in the appropriate location to seal through the releasably secured adhesive strip 36 and adjacent uncoated area, as shown in FIG. 2. The vacuum chamber is closed and a defined vacuum is placed on the chamber including the inside of the package and product. The transversely extending top heat seal 34 is applied across the entire width of the package. The vacuum is released causing air pressure to collapse the package forming the package's shape.

The package with product in it, now under defined vacuum, is removed from the vacuum chamber. A heat seal apparatus is then applied to the area of the top of the package where the handle is located to permanently seal that portion of the package together and form the area 56 for the handle. The top portion of package in the area 56 is next die cut to form the two openings 54 making up the handle. As should be appreciated by those skilled in the art the heat sealing of the portion 56 of the package around the openings 54 has the effect of reinforcing the handle. The finished top portion of the package after the formation of the handle is in the form of a flap which may be folded flat against contiguous top of the package for convenience of stacking package upon package.

Finished vacuum packages 20 constructed in accordance with this invention can be arranged and stacked in a convenient quantity, such as six packages, and shrink bundled together. The bundled packages can be placed onto a pallet. Multiples of these units can be placed on the same pallet to form a layer. Additional layers of bundled packages may be added to the same pallet until the desired pallet weight and height are obtained. The packages of this invention are under sufficient vacuum pressure inside the package, e.g., of at least 300 mm Hg, to be self-supporting on the pallet and therefore additional support for the packages, such as boxes, is not required.

As should be appreciated by those skilled in the art from the foregoing, packages of the subject invention have an air tight sealed upper end forming a spout which can readily be pulled open, e.g., peeled apart, without resulting in the destruction or tearing of any other portion of the package, particularly the seams, thereby enabling the package to be reclosed. Moreover, the peelable pour spout can be reclosed by simply pressing together the opened portion of the package, whereupon the re-closable connector holds the spout closed. The subject package thus provides an easy to open pour spout and re-closure which can hold the product packaged under vacuum to reduce package space and provide self-support without the need for secondary packaging, such as boxes. Moreover, the package may include a handle to facilitate carrying the package and dispensing the product.

While the invention has been described in detail and with reference to specific examples thereof, it will be apparent to one skilled in the art that various changes and modifications can be made therein without departing from the spirit and scope thereof.

I claim:

1. A package for holding a particulate material therein, said package being formed of a flexible material and comprising:

a front panel having a top edge, a bottom edge, a first side and an oppositely disposed second side;

a rear panel having a top edge, a bottom edge, a first side and an oppositely disposed second side;

a top transverse seal line having a length as measured between said first side and said second side of said front panel and said rear panel, said top transverse seal line being located below said top edge of said front panel and below said top edge of said rear panel and sealing said front panel to said rear panel along said length of said top transverse seal line;

a peelable seal area having a length which is less than the length of said top transverse seal line, said peelable seal area extending below said top edge of said front panel and below said top edge of said rear panel and encompassing a portion of the length of said top transverse seal line from one of said first side or said second side of said front panel and said rear panel, said portion of said top transverse seal line encompassed by said peelable seal area being only a portion of the length of said top transverse seal line, whereupon a first portion of said peelable seal area is located above said top transverse seal line and a second portion of said peelable seal area is located below said top transverse seal line, said first portion of said peelable seal area and said second portion of said peelable seal area having an equal length;

a bottom transverse seal line having a length and sealing said front panel to said rear panel along said length of said bottom seal line;

a compartment configured for receipt of the particulate material therein, said compartment being formed by portions of said front and rear panels between said bottom transverse seal line and said top transverse seal line, said second portion of said peelable seal area being located within said compartment and being configured to enable said front panel and said rear panel to be peeled open at said second portion of said peelable seal area to form a pour spout in communication with said compartment; and a re-closable connector having a length equal to the length of said second portion of said lower peelable seal line and located in said compartment interposed between said front and rear panels and immediately below said second portion of said peelable seal area, said re-closable connector configured to releasably close said pour spout after it has been opened.

2. The flexible package of claim 1 wherein said lower peelable seal line comprises no more than approximately fifty percent of said length of said top transverse seal line.

3. The flexible package of claim 1 wherein said lower peelable seal line comprises a releasably securable adhesive.

4. The flexible package of claim 2 wherein said lower peelable seal line comprises a releasably securable adhesive.

5. The flexible package of claim 1 wherein said re-closable connector comprises a press-to-close tape.

6. The flexible of claim 2 wherein said re-closable connector comprises a press-to-close tape.

7. The flexible of claim 4 wherein said re-closable connector comprises a press-to-close tape.

8. The flexible package of claim 1 wherein said package is a gusseted bag having a first gusseted side panel and a second gusseted side panel, said first gusseted side panel being secured between said front panel and said rear panel at a first side of said gusseted bag, said second gusseted side panel being secured between said front panel and said rear panel at a second side of said gusseted bag.

9. The flexible package of claim 7 wherein said package is a gusseted bag having a first gusseted side panel and a second gusseted side panel, said first gusseted side panel being secured between said front panel and said rear panel at a first side of said gusseted bag, said second gusseted side panel being secured between said front panel and said rear panel at a second side of said gusseted bag.

10. The flexible package of claim 1 additionally comprising a handle.

11. The flexible package of claim 10 wherein said handle is located in a top portion of said package above said top transverse seal line.

12. The flexible package of claim 11 wherein said handle comprises an opening in said top portion of said package.

13. The flexible package of claim 1 wherein said package is a vacuum package that is self-supporting and can be supported on a pallet without the need for additional support.

14. The flexible package of claim 13 wherein said vacuum package has vacuum pressure inside of said package of at least 300 mm Hg.

* * * * *